US010757765B2

(12) United States Patent
Hull et al.

(10) Patent No.: US 10,757,765 B2
(45) Date of Patent: Aug. 25, 2020

(54) BI-METALLIC INDUCTION HEATING BLANKET

(71) Applicant: The Boeing Company, Chicago, IL (US)

(72) Inventors: John R. Hull, Seattle, WA (US); Marc R. Matsen, Seattle, WA (US); Landon K. Henson, Seattle, WA (US)

(73) Assignee: THE BOEING COMPANY, Chicago, IL (US)

( * ) Notice: Subject to any disclaimer, the term of this patent is extended or adjusted under 35 U.S.C. 154(b) by 272 days.

(21) Appl. No.: 16/001,222

(22) Filed: Jun. 6, 2018

(65) Prior Publication Data

US 2019/0380174 A1 Dec. 12, 2019

(51) Int. Cl.

| | |
|---|---|
| ***H05B 6/10*** | (2006.01) |
| ***H05B 6/02*** | (2006.01) |
| ***A47G 9/02*** | (2006.01) |
| ***C22C 38/08*** | (2006.01) |
| ***H05B 6/04*** | (2006.01) |
| ***H05B 6/06*** | (2006.01) |

(52) U.S. Cl.

CPC ..... *H05B 6/105* (2013.01); *A47G 9/0215* (2013.01); *C22C 38/08* (2013.01); *H05B 6/04* (2013.01); *H05B 6/06* (2013.01); *H05B 2206/023* (2013.01)

(58) Field of Classification Search

CPC ..... A47G 9/0215; H05B 6/06; H05B 6/04; H05B 6/105; H05B 2206/023; C22C 38/08

USPC ..... 219/601, 602, 618, 622, 624, 615, 617, 219/633–636, 645, 647, 651, 660, 670, 219/671–677; 392/469; 148/567; 266/129

See application file for complete search history.

(56) References Cited

U.S. PATENT DOCUMENTS

| | | | |
|---|---|---|---|
| 6,566,635 | B1 | 5/2003 | Matsen et al. |
| 8,017,059 | B2 | 9/2011 | Matsen et al. |
| 9,314,975 | B1 | 4/2016 | Matsen et al. |
| 2012/0145703 | A1 | 6/2012 | Matsen et al. |

(Continued)

FOREIGN PATENT DOCUMENTS

| | | | |
|---|---|---|---|
| EP | 3169139 | A1 | 5/2017 |

OTHER PUBLICATIONS

Extended European Search Report dated Oct. 30, 2019 for European Patent Application No. 19171712.3, 6 pages.

(Continued)

*Primary Examiner* — Quang T Van

(74) *Attorney, Agent, or Firm* — MH2 Technology Law Group LLP

(57) ABSTRACT

A smart susceptor assembly includes a plurality of susceptor elements and a plurality of conductor elements. Each susceptor element can be paired with one conductor element to form a susceptor tab. When exposed to a magnetic flux field, the plurality of susceptor elements heat to a leveling temperature. During the heating, the plurality of conductor elements alter both a thermal performance and an electrical operation of the smart susceptor assembly and, more particularly, the susceptor elements. Various configurations of the susceptor elements and conductor elements are described.

20 Claims, 7 Drawing Sheets

(56) References Cited

U.S. PATENT DOCUMENTS

| | | | | |
|---|---|---|---|---|
| 2013/0082047 | A1* | 4/2013 | Matsen | H05B 6/06 219/634 |
| 2016/0143092 | A1 | 5/2016 | Miller et al. | |
| 2017/0246815 | A1 | 8/2017 | Kestner et al. | |

OTHER PUBLICATIONS

Matsen, U.S. Appl. No. 15/791,683, filed Oct. 24, 2017 entitled "Induction Molding for Parts Having Thermoplastic Portions."
Henson, U.S. Appl. No. 15/884,976, filed Jan. 31, 2018 entitled "Thermal Stability of Geometrically Complex-Shaped Smart Susceptors."

* cited by examiner

BI-METALLIC INDUCTION HEATING BLANKET

TECHNICAL FIELD

The present teachings relate to the heating of one or more materials during a heating process and, more particularly, to a smart susceptor that can be used to heat a material during a heating process.

BACKGROUND

A susceptor is a material that converts electromagnetic energy to thermal energy and may be used to heat various materials during, for example, a manufacturing process. A "smart" susceptor is a susceptor assembly that is self-regulating with regard to temperature. Typically, the smart susceptor is placed in an electromagnetic flux field that is generated by an inductor. Susceptor materials include various ferromagnetic materials, for example ferrous nickel-cobalt alloys such as Kovar®, as well as other alloys of iron, nickel, and cobalt.

At relatively low temperatures, the susceptor is highly permeable to the electromagnetic flux field and a cross sectional region through which electrons flow through the susceptor (i.e., the skin depth) is small. Thus, at these relatively low temperatures, an electrical resistance of the susceptor is high. When placed into the electromagnetic flux field generated, for example, by an induction coil that is part of the smart susceptor assembly, the susceptor begins to inductively heat due to the initially small skin depth and high magnetic permeability. As the susceptor heats, a thermal profile of the susceptor asymptotically approaches its leveling temperature where the susceptor maintains thermal equilibrium. The leveling temperature is typically a few degrees (e.g., within 2° F., or within 10° F., or within 50° F., or within 100° F.) below the smart susceptor's designed "Curie" temperature or "$T_C$", at which the susceptor becomes nonmagnetic. As the susceptor approaches its leveling temperature, the magnetic permeability of the susceptor decreases, which increases the skin depth, thereby attenuating the electrical resistance of the susceptor and reducing the heating effect. The drop in magnetic permeability limits the generation of heat at those susceptor portions at or near the leveling temperature. The magnetic permeability at a given point in time can be different for different regions of the susceptor, depending on the localized temperature at localized regions. As each localized region of the susceptor approaches the leveling temperature, the localized region becomes less magnetic until steady state (i.e., thermal equilibrium) is reached and further heating of the susceptor at the localized region ceases. Regions of the susceptor that reach the Curie temperature become nonmagnetic at or above the Curie temperature. When the susceptor begins to cool, its magnetic permeability increases, the skin depth decreases, its electrical resistance increases, and the heating process begins again.

Because of its properties of temperature self-regulation, the smart susceptor is a valuable tool in manufacturing and other uses. Some conventional designs of smart susceptors include a susceptor material wrapped around a litz wire. The litz wire can include a core with a plurality of electrically conductive strands, for example, copper strands. When an alternating current is applied to the litz wire, the litz wire generates a magnetic flux field. The susceptor absorbs the electromagnetic energy generated by the litz wire and converts it to heat. The litz wire with the susceptor wrapped therearound can be imbedded within a silicone layer to form a heat blanket that can be used, for example, to heat a carbon fiber that is pre-impregnated with an uncured resin.

Improving temperature uniformity of a heat blanket and increasing the range of leveling temperatures available for a given susceptor material would be desirable.

SUMMARY

The following presents a simplified summary in order to provide a basic understanding of some aspects of one or more implementations of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an implementation, a smart susceptor assembly includes an electromagnetic flux field source configured to generate a magnetic flux field, a plurality of susceptor elements positioned adjacent to the electromagnetic flux field source, wherein each susceptor element of the plurality of susceptor elements comprises a leveling temperature and a Curie temperature, and a plurality of conductor elements, wherein each conductor element of the plurality of conductor elements is electrically coupled to, and in thermal communication with, one of the susceptor elements of the plurality of susceptor elements.

The smart susceptor assembly can be configured to transfer a flow of electric current from each susceptor element to one of the conductor elements prior to each susceptor element reaching the Curie temperature. Optionally, the plurality of susceptor elements can be physically spaced and physically discrete, each from the others, and the plurality of conductor elements can be physically spaced and physically discrete, each from the others.

In an implementation, the smart susceptor assembly can include a plurality of susceptor tabs, with one of the susceptor elements paired with one of the conductor elements to form one of the susceptor tabs. The plurality of susceptor tabs can be arranged in a plurality of rows and a plurality of columns, the susceptor tabs within one of the rows being physically and electrically coupled to at least one other susceptor tab within the row by a pair of susceptor tab ties, and the plurality of rows can be physically and electrically spaced from one or more adjacent rows by a gap.

In another implementation, the smart susceptor assembly can include a plurality of susceptor tabs, with each susceptor tab provided by one of the susceptor elements being paired with one of the conductor elements, the plurality of susceptor tabs can be arranged in a plurality of rows and a plurality of columns, each row can be physically spaced from one or more adjacent rows by a gap, each susceptor tab can be electrically coupled to at least one adjacent susceptor tab by a pair of susceptor tab ties, and each susceptor tab can be electrically coupled to every other susceptor tab of the plurality of susceptor tabs.

Optionally, the smart susceptor assembly can include a plurality of susceptor tabs, with each susceptor tab provided by one of the susceptor elements paired with one of the conductor elements, and the susceptor element of each susceptor tab can be coextensive with the conductor element paired therewith. Further, each susceptor tab can have a length and a width, the length of each susceptor tab can be from 1 mm to 200 mm, and the width of each susceptor tab can be from 1 mm to 100 mm.

In an optional implementation, each susceptor element can include at least one of an iron alloy, a nickel alloy, a cobalt alloy, and/or a ferrous nickel-cobalt alloy, and each conductor element can include at least one of copper, silver, gold, bronze, and/or non-magnetic copper-nickel. The electromagnetic flux field source can be at least partly provided by a conductor wire that overlies the plurality of susceptor elements, and the smart susceptor assembly can further include an alternating current power supply electrically coupled to the conductor wire. Further, each susceptor element of the plurality of susceptor elements can be coextensive with one of the conductor elements of the plurality of conductor elements to provide a susceptor tab, and the conductor wire can be physically attached to each susceptor tab.

In another implementation, a method for manufacturing a smart susceptor assembly includes forming a plurality of susceptor tabs having a plurality of susceptor elements and a plurality of conductor elements, wherein susceptor element is electrically coupled to, and in thermal communication with, one of the conductor elements, and each susceptor element includes a leveling temperature and a Curie temperature. The method further includes positioning an electromagnetic flux field source adjacent to the plurality of susceptor tabs.

Optionally, the forming of the plurality of susceptor tabs can include physically spacing the plurality of susceptor elements, each from the others, and physically spacing the plurality of conductor elements, each from the others. The method can further include positioning the plurality of susceptor tabs in a plurality of rows and a plurality of columns, physically and electrically coupling the susceptor tabs of the rows to at least one other susceptor tab within the row using a pair of susceptor tab ties, and physically and electrically spacing the rows of susceptor tabs from one or more adjacent rows by a gap. Additionally, the method can further include positioning the plurality of susceptor tabs in a plurality of rows and a plurality of columns, physically spacing each row from one or more adjacent rows by a gap, electrically coupling each susceptor tab to at least one adjacent susceptor tab using a pair of susceptor tab ties, and electrically coupling each susceptor tab to every other susceptor tab of the plurality of susceptor tabs. Each susceptor element can be formed to overlie, and to be coextensive with, one of the conductor elements. Each susceptor tab can be formed to have a length of from 1 mm to 200 mm, and to have a width of from 1 mm to 100 mm. The method can further include attaching a conductor wire to each of the plurality of susceptor tabs during the positioning of the electromagnetic flux field source adjacent to the plurality of susceptor tabs, wherein the conductor wire serpentines across the plurality of susceptor tabs, and may include electrically coupling the conductor wire to an alternating current power source.

In another implementation, a method for heating an article includes placing the article adjacent to a smart susceptor assembly, wherein the smart susceptor assembly includes an electromagnetic flux field source configured to generate a magnetic flux field, a plurality of susceptor elements positioned adjacent to the electromagnetic flux field source, wherein each susceptor element of the plurality of susceptor elements comprises a leveling temperature and a Curie temperature, and a plurality of conductor elements, wherein each conductor element of the plurality of conductor elements is electrically coupled to, and in thermal communication with, one of the susceptor elements of the plurality of susceptor elements. The method further includes generating an electromagnetic flux field from the electromagnetic flux field source, inductively heating the plurality of susceptor elements using the electromagnetic flux field, and heating the article using heat from the plurality of susceptor elements. Optionally, the method can further include transferring a flow of electric current from each susceptor element to one of the conductor elements prior to each susceptor element reaching the Curie temperature.

BRIEF DESCRIPTION OF THE DRAWINGS

The accompanying drawings, which are incorporated in, and constitute a part of this specification, illustrate implementations of the present teachings and, together with the description, serve to explain the principles of the disclosure. In the figures.

Figure 1:
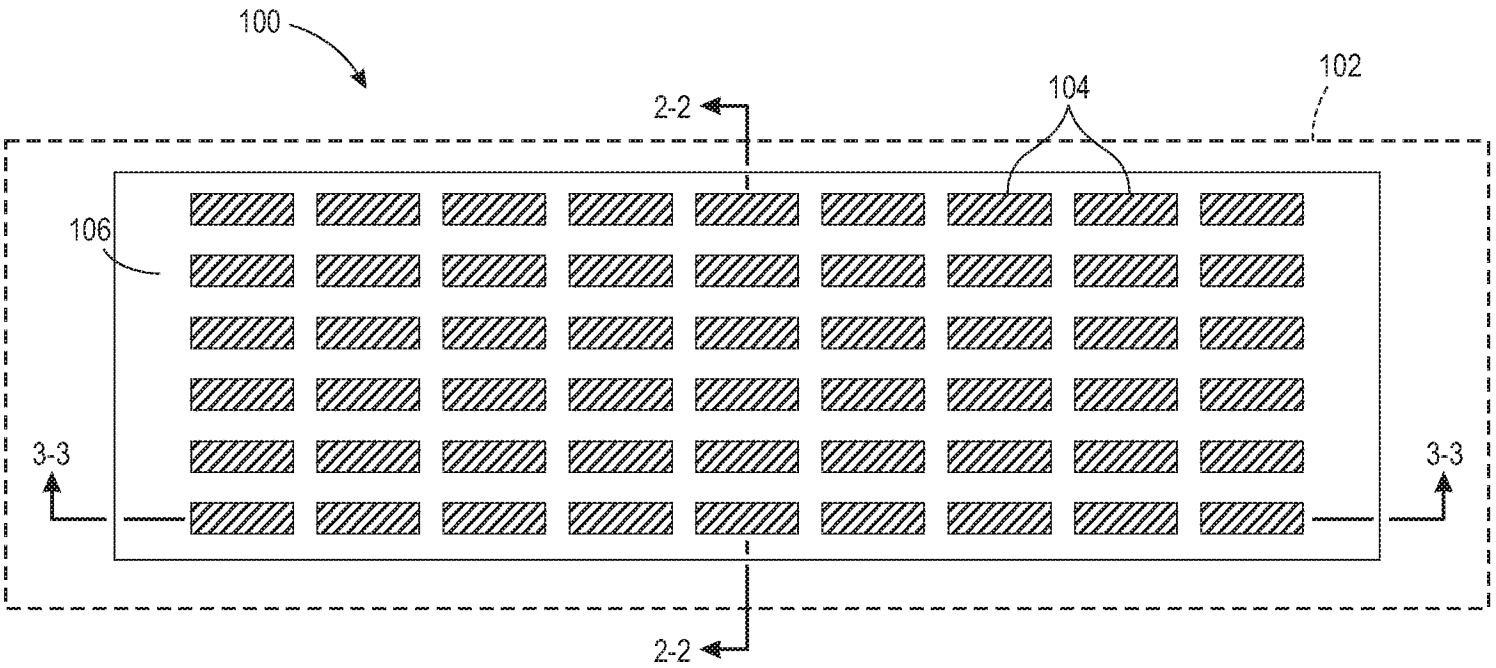
FIG. 1 is a plan view of a portion of a smart susceptor assembly in accordance with an implementation of the present teachings.

It should be noted that some details of the figures have been simplified and are drawn to facilitate understanding of the present teachings rather than to maintain strict structural accuracy, detail, and scale.

DETAILED DESCRIPTION

Reference will now be made in detail to exemplary implementations of the present teachings, examples of which are illustrated in the accompanying drawings. Generally, wherever convenient, the same reference numbers will be used throughout the drawings to refer to the same or like parts.

As used herein, unless otherwise stated, the term "bi-metallic" refers to a structure having at least two individual metal layers. In one aspect, the at least two individual metal layers can be arranged parallel to a major plane such as a plane of a substrate that directly or indirectly supports the bi-metallic structure. The two metal layers can be electrically connected together through physical contact with each other or by one or more other metal layers using, for example, a brazing process, a soldering process, etc. Further, as used herein, unless otherwise stated, the term "metal" refers to a metal or a metal alloy.

While temperatures across the susceptor heat blanket having a susceptor-wrapped litz wire described above can be more uniform compared to other types of heating devices, a more precisely controlled temperature uniformity across the susceptor heat blanket is desired. Further, the susceptor heat blanket having a susceptor-wrapped litz wire described above relies on a close proximity of adjacent wire structures that includes several parallel paths of conductor which can result in inductive coupling between the adjacent parallel conductor structures and an uneven current flow in the different parallel circuits, which can decrease heating uniformity across the heat blanket. An implementation of the present teachings can have more efficient operational characteristics that allow the adjacent parallel conductor structures to be formed further apart than conventional designs, thereby mitigating inductive coupling between adjacent structures and providing a smart susceptor assembly having a more precisely controlled temperature uniformity across the smart susceptor assembly than some conventional designs.

Additionally, the Curie and leveling temperatures of a susceptor material depends on its chemistry, and the development of new susceptor chemistries for an increased range of available leveling temperatures is expensive, both from a research and a manufacturing point of view. Each susceptor material chemistry has only a limited range of possible leveling temperatures depending on the current applied to the litz wire. The ability to adjust leveling temperature by increasing the power to the heating blanket or changing the excitation frequency is often limited by the available power supplies. Furthermore, the ability to adjust per area heating by altering the spacing of the spiral turns of the susceptor is also limited. An implementation of the present teachings can extend the available leveling temperature ranges for a given susceptor material by, at least in part, providing a conductor element that alters the thermal and electrical operation of the smart susceptor assembly to extend the range of available leveling temperatures.

An implementation of the present teachings can include one or more of the elements, components, and/or features as described herein and/or depicted in the figures. It will be understood that a completed or an in-process smart susceptor assembly can include various elements and/or features that have not been depicted or described herein for simplicity, while various other components depicted and/or described herein can be removed or modified.

Figure 2:
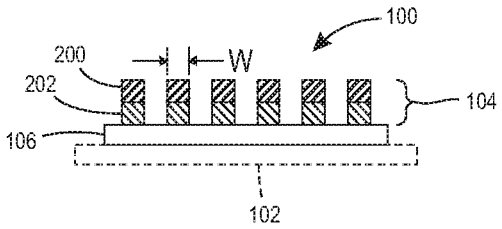
FIG. 2 is a cross section along 2-2 of the FIG. 1 structure.
Figure 3:
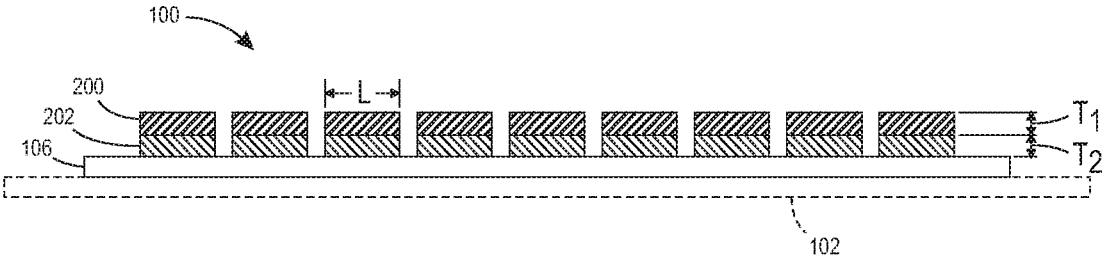
FIG. 3 is a cross section along 3-3 of the FIG. 1 structure.

FIG. 1 is a plan view, FIG. 2 is a cross section along 2-2 of FIG. 1, and FIG. 3 is a cross section along 3-3, depicting a portion of a smart susceptor assembly 100 overlying a structure or article 102 (depicted in phantom) to be heated according to an implementation of the present teachings. The smart susceptor assembly 100 of this implementation includes a plurality of physically discrete bi-metallic susceptor assemblies or susceptor "tabs" 104. The bi-metallic structure of each susceptor tab 104 includes a susceptor element 200 and a conductor element 202. The susceptor tabs 104 can be positioned on an electrically insulative substrate (e.g., a first electrically insulative substrate) 106, for example, a silicone layer (e.g., a first silicone layer). While FIG. 1 depicts a smart susceptor assembly 100 having a 6×9 array (i.e., an array having 6 rows and 9 columns) of uniform susceptor tabs 104, it will be appreciated that other array sizes are contemplated, depending, for example, on the size of the article 102 to be heated, the dimensions of the susceptor tabs 104, or other design considerations. Further, the susceptor tabs 104 can be different shapes and/or sizes to better conform to a specific geometry.

As depicted in FIGS. 2 and 3, each susceptor element 200 and conductor element 202 has a depth or length "L" and a width "W", where the length and width of each susceptor element 200 is targeted to be the same as the length and width of each conductor element 202 for each susceptor tab 104, such that the sidewalls of each structure align vertically. In other words, the susceptor element 200 and the conductor element 202 of each susceptor tab 104 are targeted to be coextensive with each other in the lateral direction. Further, each susceptor element 200 can have a first thickness "$T_1$" and each conductor element 202 can have a second thickness "$T_2$" as depicted in FIG. 3.

The susceptor elements 200 can be or include a ferromagnetic susceptor material, for example, one or more of an iron alloy, a nickel alloy, a cobalt alloy, and a ferrous nickel-cobalt alloy, or another suitable material. The conductor elements 202 can be or include an electrical conductor that is non-magnetic or paramagnetic and, preferably, is also a good thermal conductor. Suitable materials include copper, silver, gold, bronze, and/or non-magnetic copper-nickel, or another suitable material. For simplicity, the various implementations discussed below are described with reference to the use of an iron alloy susceptor material for the susceptor elements 200 and copper for the conductor elements 202, although it will be appreciated that other materials would also be suitable.

Each susceptor tab 104 can have a length "L" of from about 1 mm to about 200 mm, for example, from about 10 mm to about 50 mm. Further, each susceptor tab 104 can have a width "W" of from about 1 mm to about 100 mm, for example, from about 5 mm to about 20 mm. Forming susceptor tabs 104 with excessively large lengths and/or widths increases the difficulty of (or prevents) heating the extremities of the susceptor tab 104 to a sufficient temperature with a single current-carrying conductor traversing the length. Forming susceptor tabs with excessively small lengths and/or widths makes it difficult to prevent the current-carrying conductors from inductively coupling.

The portion of the smart susceptor assembly 100 depicted in FIGS. 1-3 can be formed using any suitable process. For example, a laminated bi-metallic sheet including a blanket layer of a conductor element material (e.g., copper layer) and a blanket layer of a susceptor element material (e.g., an iron alloy layer) can be provided or formed on the insulative substrate 106. The two layers of the bi-metallic sheet can physically contact each other such that the conductor element material is electrically coupled to, and in thermal communication with, the susceptor element material. In one formation method, a sintering process can be used to form a bi-metallic sheet. A pre-formed strip of susceptor material can be uncoiled from a reel and flattened in a straightener. A washing process can be used to remove contaminants and particles from the pre-formed strip. The pre-formed strip can be sanded to provide a textured surface and to thin the pre-formed strip to a desired thickness, and then a metal powder, for example, powdered copper metal or powdered copper alloy can be deposited onto the textured surface. The pre-formed strip of susceptor material with the metal powder thereon is then heated, for example, in a sleeve-type continuous sintering furnace in a suitable atmosphere and at a suitable temperature to sinter the metal powder. Subsequently, the bi-metallic strip is cooled then compacted in a rolling mill to densify the sintered metal powder by removing pores between the joined particles. The bi-metallic strip can be re-sintered at a suitable temperature in a suitable atmosphere to weld the particles of the metal powder closed during compaction, then cooled. The bi-metallic strip can be rolled to strengthen and strain-harden the bi-metallic strip, and may be run through a punch to pattern the bi-metallic strip, for example, in preparation of the structure described below with reference to FIGS. 5-8. Subsequently, the bi-metallic strip can be wound on a reel for storage, shipment, and/or preparation for use. Other sufficient formation methods include hot rolling, plasma spraying, electroplating, brazing, soldering, and welding. A patterned mask layer (not depicted for simplicity) can be formed on or over the layer of susceptor element material. Subsequently, the susceptor element material and the conductor element material can be etched and patterned to approximate the pattern of the patterned mask layer using one or more suitable wet or dry etches, stopping on the insulative substrate 106. The patterned mask can then be removed to result in the portion of the smart susceptor assembly 100 depicted in FIGS. 1-3. In another process, instead of a mask and etch, the laminated sheet including the blanket layers of susceptor element material and conductor element materials can be mechanically etched using, for example, a dicing saw. Additionally, the susceptor tabs 104 can be formed at a location away from the insulative substrate 106 and subsequently positioned onto the insulative substrate 106 using, for example, pick-and-place equipment. It will be appreciated that an oversized assembly including the insulative substrate 106 and a plurality of susceptor tabs 104 can be formed and then cut to a desired size. An adhesive (not individually depicted for simplicity) can be rolled, sprayed, or otherwise deposited onto the insulative substrate 106, which will allow permanent positioning of the susceptor tabs 104.

Figure 4:
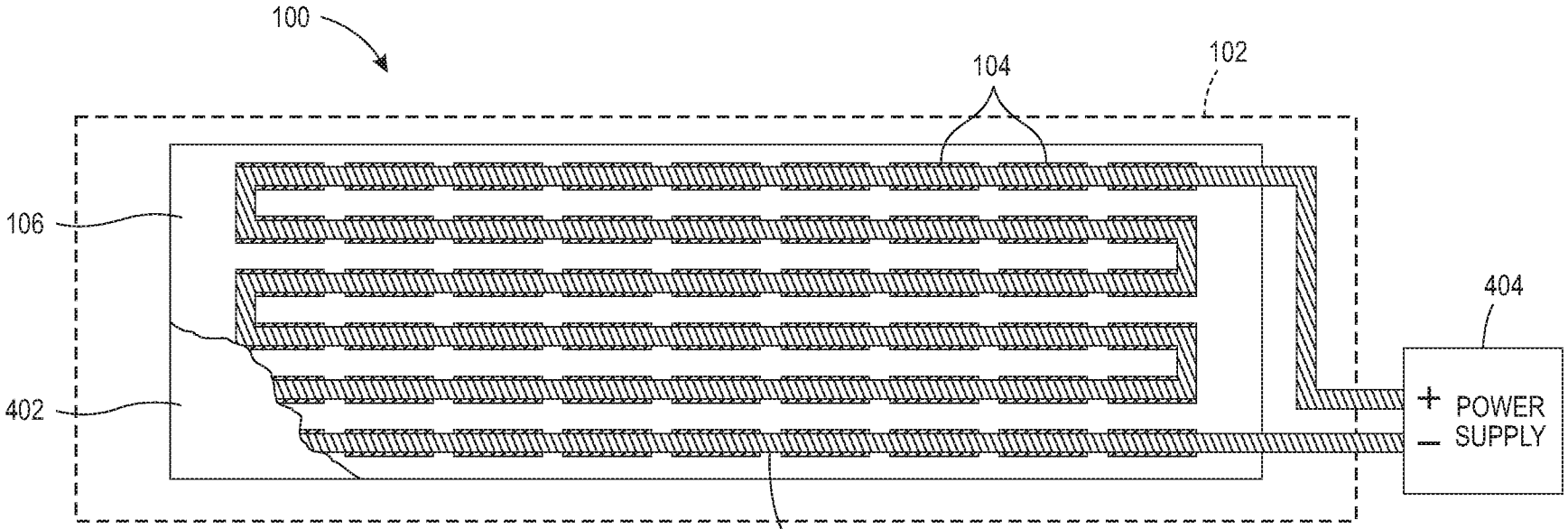
FIG. 4 depicts the FIG. 1 structure after the inclusion of additional elements and features.

After forming the portion of the smart susceptor assembly 100 of FIGS. 1-3, an electromagnetic flux field source such as a current-carrying wire (i.e., conductor wire) 400 configured to function as an inductor to generate a magnetic flux field can be positioned over each of the susceptor tabs 104 as depicted in FIG. 4. As depicted, the conductor wire 400 serpentines across the surface of the insulative substrate 106 and across the array of susceptor tabs 104. A width of the conductor wire 400 will typically less than the width "W" of the susceptor tabs 104. In one implementation, the conductor wire 400 can be a copper litz-wire bundle, designed to have low Joule heating loss at the operating frequency of the smart susceptor assembly 100, for example, when used as a heating blanket. The conductor wire 400 is electrically insulated from the susceptor tabs 104, but can be physically attached to one or more of the susceptor tabs 104, for example to one or more of the susceptor elements 200, using an adhesive (not individually depicted for simplicity).

The smart susceptor assembly 100 can further include an electrically insulative substrate (e.g., a second insulative substrate) 402, such as a silicone layer (e.g., a second silicone layer) that overlies the conductor wire 400 and the susceptor tabs 104. The second silicone layer 402 is depicted in FIG. 4 in cutaway to reveal the underlying conductor wire 400 and susceptor tabs 104, but can be generally be coextensive with the first silicone layer 106. The susceptor tabs 104 and at least a portion of the conductor wire 400 may therefore be at least partially sandwiched between the first electrically insulative substrate 106 and the second electrically insulative substrate 402. First and second ends of the conductor wire 400 may be electrically coupled with an alternating current (AC) power supply 404 having a desired frequency using, for example, electrical connectors and/or a cable (not depicted for simplicity). The operating specifications of the power supply 404 can be matched to the requirements of the susceptor assembly including the conductor wire 400 and the susceptor tabs 104. One or more adhesives (not individually depicted for simplicity) can be used to secure the current-carrying conductor wire 400 to the susceptor tabs 104, and to secure the second electrically insulative substrate 402 over the current-carrying conductor wire 400 and susceptor tabs 104.

It will be appreciated that, in one aspect, the smart susceptor assembly 100 of FIG. 4 can be used as a heater blanket 100 during, for example, a manufacturing process. It will be further appreciated that two or more heater blankets 100 can be positioned adjacent to each other to form a larger heater blanket array. While FIG. 4 depicts a rectangular heater blanket 100, it will be appreciated that other shapes are contemplated.

When an alternating current is applied to the conductor wire 400 by the power supply 404, the conductor wire 400 functions as an inductor and generates a magnetic flux field. The magnetic field generated by the conductor wire 400 is largest directly beneath the conductor wire 400, and the susceptor element 200 positioned adjacent to the conductor wire 400 heats more at this location than at susceptor element 200 locations laterally positioned further away from the conductor wire 400. As the susceptor elements 200 heat from exposure to the magnetic field generated by the conductor wire 400, the heat transfers from the susceptor elements 200 to and through the conductor element 202. The heat is then distributed from the conductor element 202 of the susceptor tab 104 to the article 102 through the electrically insulative substrate 106.

In an implementation, the conductor element 202 can alter both the thermal performance and the electrical operation of the smart susceptor assembly 100 as described below compared to a conventional smart susceptor.

With regard to thermal performance, the conductor element 202 can function as a passive heat exchanger to dissipate thermal energy from the susceptor element 200 to the electrically insulative substrate 106 and to the article 102 to be heated. In this capacity, the conductor element 202 provides passive regulation of the temperature across the surface of the susceptor element 200, both on an exterior surface and at the interior of the susceptor element 200. This decreases the range of temperature across the surface of the susceptor element 200 and allows for more precise thermal control of heating across the smart susceptor assembly 100.

With regard to electrical operation, the conductor element 202 can provide a current path after one or more regions or portions of a particular susceptor element 200 become low permeability after approaching the Curie temperature and/or reaching the leveling temperature. As described above, at relatively low temperatures the susceptor element 200 is highly permeable to an electromagnetic flux field and the skin depth is small. At these relatively low temperatures, the electrical resistance of the susceptor element 200 is high. When placed into an electromagnetic flux field generated from the conductor wire 400, the susceptor element 200 begins to inductively heat, the skin depth of the susceptor element 200 increases and the magnetic permeability decreases, thereby attenuating the electrical resistance of the susceptor element 200 and reducing the heating effect. The susceptor element 200 becomes increasingly nonmagnetic, at which point the flow electric current is transferred to the conductor element 202 and thus begins to flow through the conductor element 202 rather than the susceptor element 200 prior to the susceptor element 200 reaching the Curie temperature. Once the susceptor element 200 begins to cool, the skin depth decreases, the magnetic permeability increases, and the electric current from the conductor wire 400 begins to flow through the susceptor element 200, and the susceptor element 200 begins to heat until reaching the leveling temperature.

The implementation of FIG. 4 thus includes a plurality of (an array of) susceptor tabs 104 that can be formed from a bi-metallic sheet. Each tab 104 includes a susceptor element 200 and a conductor element 202 where, with each susceptor tab 104, the susceptor element 200 physically, electrically, and thermally contacts and/or is coupled with the conductor element 202. Each susceptor tab 104 is physically discrete from every other susceptor tab 104 of the plurality of susceptor tabs 104 in the array, and each susceptor tab 104 is physically spaced from each of the other susceptor tabs 104 in the array by a gap. Further, each susceptor element 200 is physically discrete and physically spaced from every other susceptor element 200 of the plurality of susceptor elements 200 in the array. Additionally, each conductor element 202 is physically discrete and physically spaced from every other conductor element 202 of the plurality of conductor elements 202 in the array. Moreover, as depicted in FIGS. 1-3 and 5-7, each conductor element 202 is paired one-to-one with one of the susceptor elements 200.

The susceptor assembly 100 further includes an inductor that can be provided by a conductor wire 400 overlying each susceptor tab 104. The susceptor assembly 100 can further include an underlying first insulative substrate 106 and an overlying second insulative substrate 402, where the plurality of susceptor tabs 104 and at least a portion of the conductor wire 400 is positioned directly between the two insulative substrates. The conductor wire 400 generates a magnetic flux field when power is applied thereto by a AC power supply 404.

FIGS. 1-4 generally depict the susceptor elements 200 vertically positioned between the conductor wire 400 and the conductor elements 202. In this implementation, the susceptor elements 200 for each susceptor tab 104 are closer to the conductor wire 400 than the conductor elements 202. Further, in this implementation, the conductor elements 202 are physically positioned closer to the first electrically insulative substrate 106 and the article 102 to be heated than the susceptor elements 200. It will be appreciated that the position of the susceptor elements 200 and the conductor elements 202 can be reversed, such that the susceptor elements 200 are vertically positioned between the conductor wire 400 and the conductor elements 202, with the conductor elements 202 closer to the conductor wire 400 than the susceptor elements 200. Generally, however, the conductor wire 400 will have the greatest effect on the susceptor elements 200 when positioned adjacent to the susceptor elements 200. Additionally, heat transfer from the conductor elements 202 to the article 102 to be heated will be greatest when the conductor elements 202 are positioned adjacent to the first electrically insulative substrate 106 and the article 102.

Figure 5:
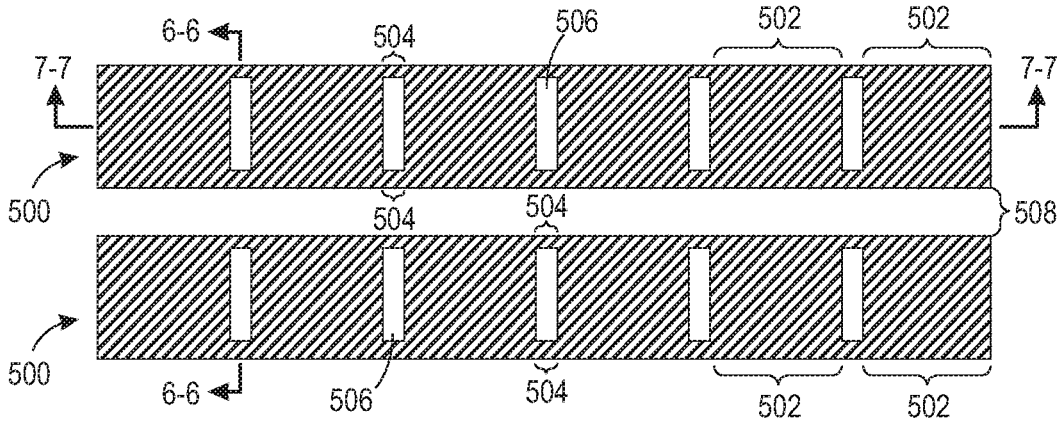
FIG. 5 is a plan view of a plurality of susceptor tabs according to another implementation of the present teachings.
Figure 6:
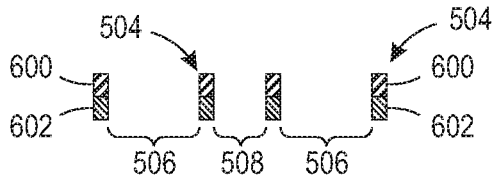
FIG. 6 is a cross section along 6-6 of FIG. 5.
Figure 7:
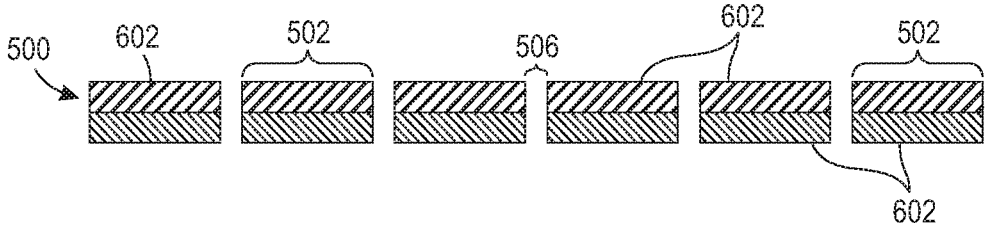
FIG. 7 is a cross section along 7-7 of FIG. 5.

FIG. 5 is a plan view, FIG. 6 is a cross section along 6-6 of FIG. 5, and FIG. 7 is a cross section along 7-7 of FIG. 5, of another implementation of the present teachings. FIGS. 5-7 depict two susceptor tab strips 500, with each strip including a plurality of susceptor tabs 502. FIGS. 5-7 depict a 2×6 array (i.e., an array having 2 rows and 6 columns) of susceptor tabs 502, although it will be appreciated that other array sizes are contemplated, depending, for example, on the size of the article to be heated, the dimensions of the susceptor tabs 502, or other design considerations.

In this implementation, each susceptor tab 502 in a row of susceptor tabs 502 that form a susceptor tab strip 500 is physically and electrically coupled to at least one other susceptor tab 502 within the strip by a pair of susceptor tab ties 504 as depicted in FIG. 5. Each row of susceptor tabs 502 can thus be provided by a rectangular bi-metallic susceptor tab strip 500 that defines a plurality of apertures 506, for example, rectangular apertures. Each pair of susceptor tab ties 504 is provided by, or formed at, the ends of one of the apertures 506. As further depicted in FIG. 5, each row of susceptor tabs 502 is physically and electrically separated or spaced from one or more adjacent rows by a gap 508.

It will be appreciated that the susceptor tabs 502 of FIG. 5 can be used in place of the susceptor tabs 104 of FIG. 4, such that the completed smart susceptor assembly can include the susceptor tabs 502, the conductor wire 400, the first 106 and second 402 electrically insulative substrates, and the power supply 404.

The implementation of FIG. 5 may simplify construction of the smart susceptor assembly compared to the implementation of FIG. 4. With the implementation of FIG. 4, each susceptor tab 104 is physically and electrically separated from every other susceptor tab 104 in the array and, depending on the method of manufacture, must be positioned and otherwise handled individually. With the implementation of FIG. 5, the susceptor tabs 502 of each row are physically connected together to form an elongated susceptor tab strip 500 of physically and electrically connected susceptor tabs 502, and the strip can be positioned and otherwise handled together as a bi-metallic strip of a plurality of susceptor tabs 502.

In the implementation of FIGS. 5-7, adjacent susceptor tabs 104 are connected together by susceptor tab ties 504 at the lateral edges of the susceptor tab strips 500. These susceptor tab ties 504 may adversely affect the current flow during use of the smart susceptor assembly 100 only to a small degree, but advantageously add mechanical integrity to the array of susceptor tabs 502, which makes it easier to manufacture into a heating blanket. The structure can be manufactured from a solid bi-metallic strip, for example, by punching apertures 506 between adjacent susceptor tabs 502 using a metal punch.

Figure 8:
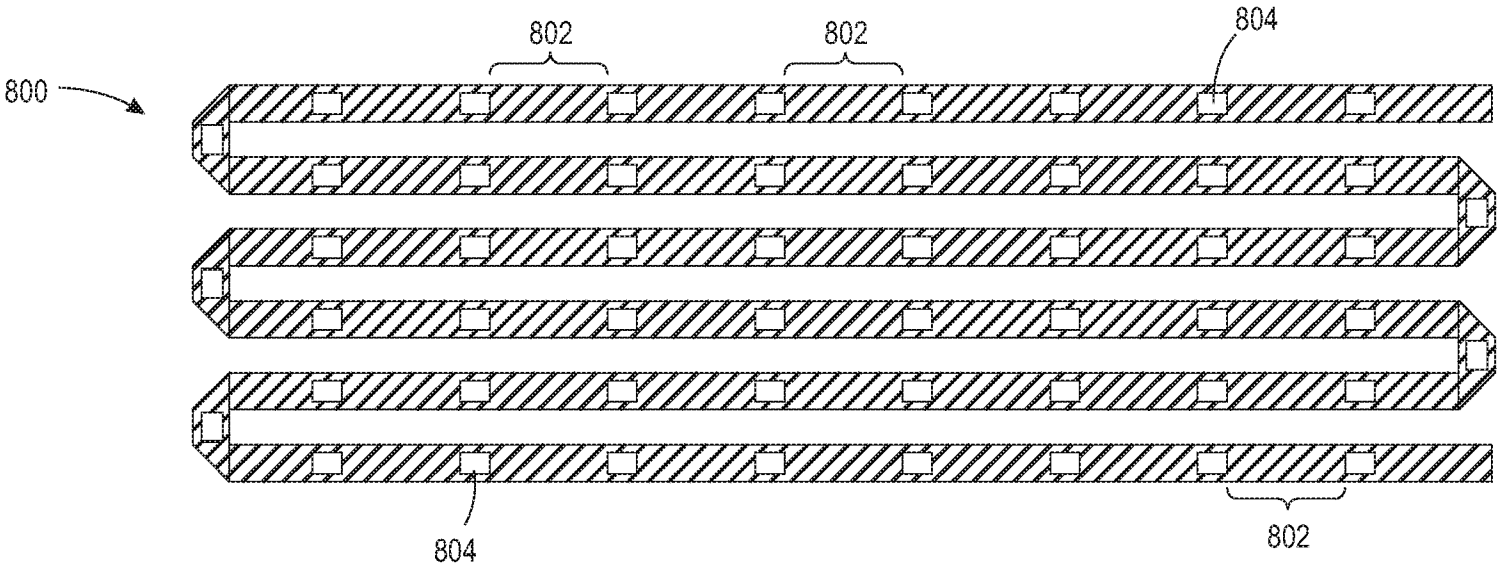
FIG. 8 is a plan view of a plurality of susceptor tabs according to another implementation of the present teachings.

FIG. 8 depicts another implementation of the present teachings in which a single elongated susceptor tab strip 800 including a plurality (e.g., an array) of susceptor tabs 802 is folded to form an entire array of susceptor tabs 802. As depicted, the plurality of susceptor tabs 802 are arranged in a plurality of rows and a plurality of columns. Each susceptor tab 802 of each row is separated from at least one other susceptor tab 802 in the row by an aperture 804 such as a rectangular aperture or an aperture having another shape. Further, each row is physically separated from at least one adjacent row by a gap, and each susceptor tab 802 is electrically coupled with every other susceptor tab 802 of the plurality of susceptor tabs 802.

As discussed above relative to FIGS. 5-7, the susceptor tab strip 800 can be formed by punching the plurality of apertures 804 into a bi-metallic strip using a punch. The bi-metallic strip can then be folded over at 90° angles, or another angle as desired, as depicted in FIG. 8 to form the array of susceptor tabs 802. It will be appreciated that the elongated susceptor tab strip 800 of FIG. 8 can be used in place of the susceptor tabs 104 of FIG. 4, such that the completed smart susceptor assembly can include the elongated susceptor tab strip 800, the conductor wire 400, the first 106 and second 402 electrically insulative substrates, and the power supply 404. Providing a single strip of bi-metallic susceptor tabs 802 may simplify construction of the smart susceptor assembly 100.

Figure 9:
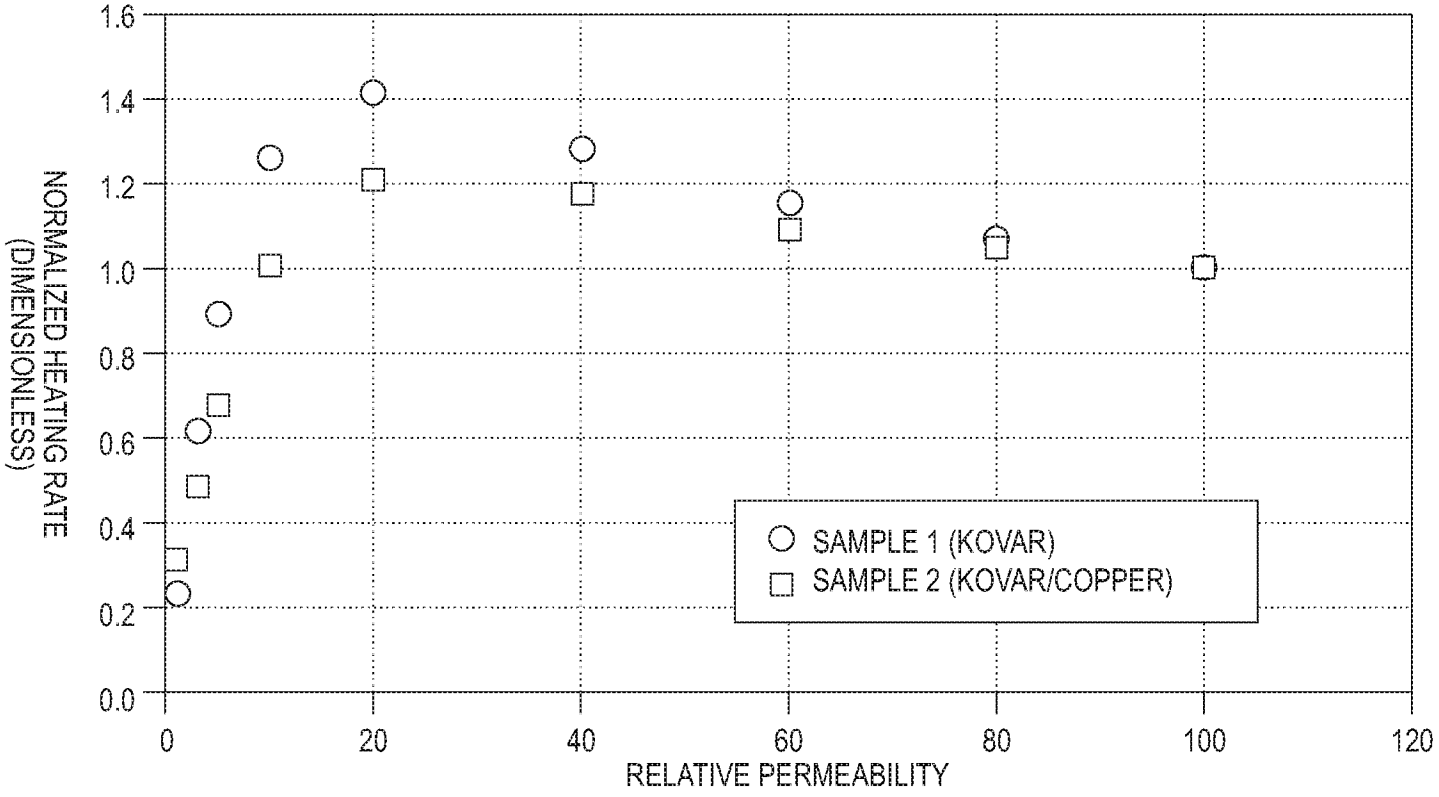
FIG. 9 is a graph comparing operational characteristics of a susceptor element without an associated conductor element to a susceptor element with an associated conductor element.

FIG. 9 is a graph depicting operational results of an example calculation for two different sample susceptor tabs, where each susceptor tab has a 30 mm width, a 120 mm length, and a 6 mm thickness. The susceptor tab of sample 1 includes only one metallic element, a 6 mm thickness of susceptor material (Kovar) and no conductor element. The susceptor tab of sample 2 includes a bi-metallic susceptor tab having a 3 mm thick ($T_1$, FIG. 3) susceptor element (Kovar) and a 3 mm thick ($T_2$, FIG. 3) conductor element (copper). The excitation current and frequency applied to each sample is the same in each case (2 kilohertz) and the heating rate has been normalized to the heating rate when the relative permeability of the susceptor material is 100. The leveling temperature occurs in the region near the relative permeability of unity and, within this region, the steeper the curve the narrower the temperature range around the leveling temperature that can be achieved. As shown in FIG. 9, the slope in this region is approximately the same for Sample 1 and Sample 2. At a relative permeability of 100, the heating rate for Sample 2 was 8.12 W, while that for the pure susceptor material was 6.75 W. Even at the maximum heating rate, Sample 2 has a heating rate of 9.92 W, compared to the 9.52 W of Sample 1. This demonstrates that the bi-metallic configuration of Sample 2 can achieve the same heating with less current excitation compared to Sample 1, and thus a lower power can be applied to reach the leveling temperature in the same amount of time. Alternatively, for the same applied power, Sample 2 will reach the leveling temperature more quickly than Sample 1.

When the thickness of the copper layer in Sample 2 was reduced to 1.5 mm from 3.0 mm, the heating rate at a relative permeability of 100 was 8.01 W, just slightly reduced from the 8.12 W of the bi-metallic susceptor tab of Sample 2 having a 3 mm thickness of copper. However, the heating at a relative permeability of unity was 2.02 W, whereas for the 3 mm thick copper of Sample 2, the heating was 2.58 W. Thus, the thickness of the copper layer on the susceptor tab can be used to control the amount of heating available at the leveling temperature, with thinner thicknesses producing less heating and, because of the smaller mass of susceptor tab material, reaching the leveling temperature more rapidly. However, the thinner copper layer will also result in lower conductive heat transfer from the center of the susceptor tab, where the current-carrying wire is located, to the extremities of the susceptor tab.

Figure 10:
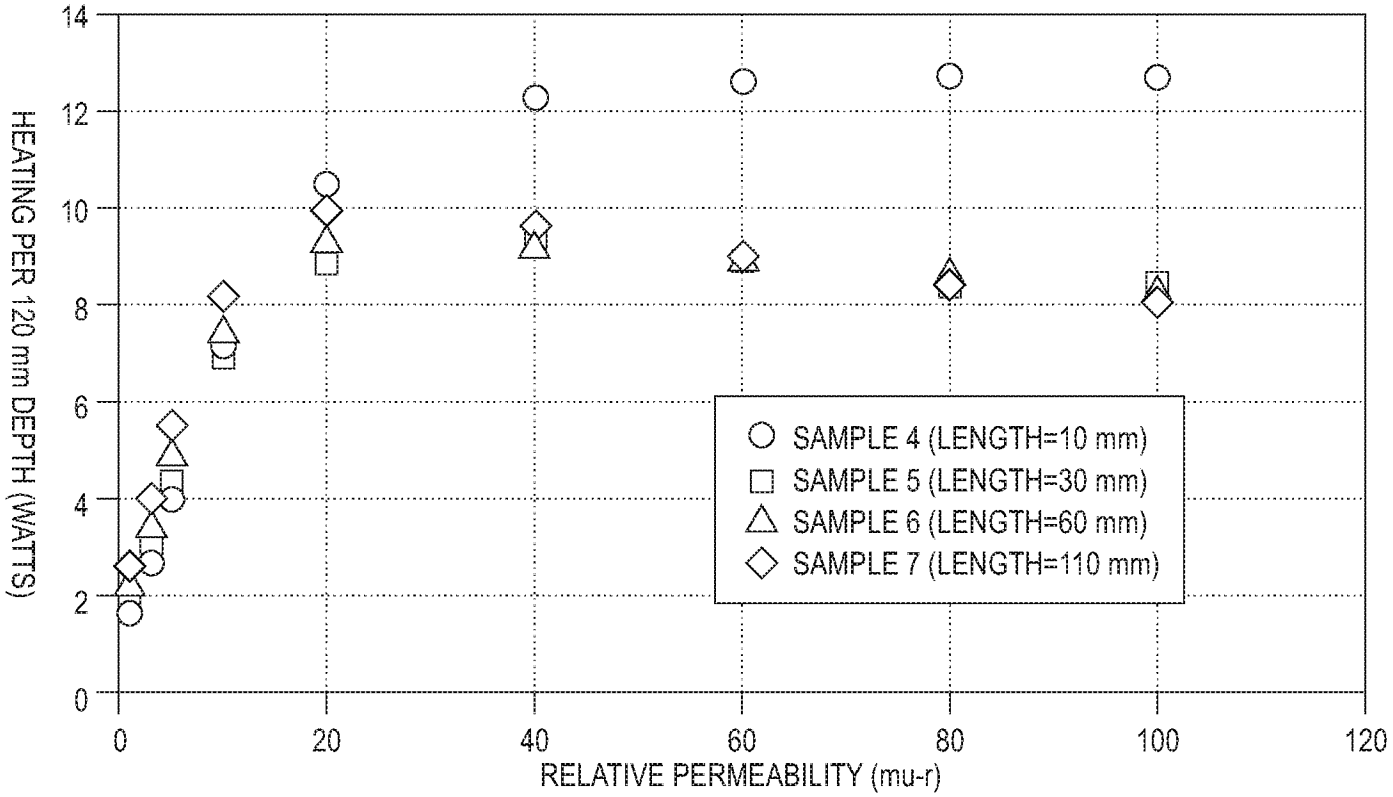
FIG. 10 is a graph comparing operational characteristics of susceptor tabs having the same width and thickness but different lengths.

As shown in FIG. 10, the heating of a bi-metallic susceptor tab in accordance with the present teachings is also affected at low relative permeability by changing the depth or length "L" (FIG. 3) relative to the width "W" FIG. 2). FIG. 10 depicts heating for four different samples, each having a bi-metallic susceptor tab with a 3 mm thick Kovar susceptor element and a 3 mm thick copper conductor element, having a width "W" of 30 mm, and varying the length "L". The effect is particularly evident once the length is less than the width. For Sample 4, the heating is rate larger than for samples 5-7 at high relative permeability and the heating rate is lower than the other cases at a relative permeability of unity. For the Samples 5-7 having a length greater than or equal to width, heating at high relative permeability is essentially the same but there is considerable variability of the heating at lower relative permeability. Examining the heating in FIG. 9 at about 2.5 W, changing the depth from 120 mm to 10 mm, changes the associated relative permeability from 1 to 3, which could be equivalent to several degrees of temperature for many susceptor materials, thus expanding the range of leveling temperatures available for each susceptor material.

The structures of FIGS. 4, 5, and 8 can be used to perform a heating process during the formation of virtually any type of article of manufacture. Some examples include, but are not limited to, aerospace vehicles, military, commercial, or private flight vehicles, reusable spacecraft, and re-entry systems. As used herein, "aircraft" refers to any vehicle capable of flight within an atmosphere, partial vacuum, and/or vacuum. Referring back to FIG. 4, the article 102 can be a composite part including a plurality of composite plies or sheets that are pre impregnated with an uncured resin (i.e., a prepreg). As depicted, the smart susceptor assembly 100, particularly the array of susceptor tabs 104 including the susceptor elements 200 and the conductor elements 202, are placed adjacent to the article 102. Current is applied by the power supply 404 to the conductor wire 400, which generates a magnetic flux field that inductively heats the plurality of susceptor tabs 104. A leveling temperature of the susceptor tabs 104 can be targeted for a desired temperature based on the principles discussed above, for example, a mass and/or composition of the susceptor element 200, a mass and/or composition of the conductor element 202, and the current applied to the susceptor tabs 104 by the power supply 404. When the article 102 is a prepreg, the leveling temperature can be targeted so as to cure the uncured resin of the prepreg, or can be targeted so as to heat but not cure the resin of the prepreg. Heat from the susceptor tabs 104 can be applied to the article 102 for a desired duration of time, depending on the article 102 being heated and the desired end result of the specific process.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or implementations of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. As used herein, the term "one or more of" with respect to a listing of items such as, for example, A and B, means A alone, B alone, or A and B. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated implementation. Finally, "exemplary" indicates the description is used as an example, rather than implying that it is an ideal. Other implementations of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A smart susceptor assembly, comprising:

an electromagnetic flux field source configured to generate a magnetic flux field, wherein the electromagnetic flux field source comprises a conductor wire;

a plurality of susceptor elements positioned adjacent to the conductor wire of the electromagnetic flux field source, wherein each susceptor element of the plurality of susceptor elements comprises a leveling temperature and a Curie temperature; and a plurality of conductor elements, wherein each conductor element of the plurality of conductor elements is electrically coupled to, in thermal communication with, and paired one-to-one with one of the susceptor elements of the plurality of susceptor elements, wherein the conductor wire extends adjacent to each susceptor element of the plurality of susceptor elements and each conductor element of the plurality of conductor elements.

2. The smart susceptor assembly of claim 1, wherein the smart susceptor assembly is configured to transfer a flow of electric current from each susceptor element to one of the conductor elements prior to each susceptor element reaching the Curie temperature.

3. The smart susceptor assembly of claim 1, wherein:

the plurality of susceptor elements are physically spaced and physically discrete, each from the others; and the plurality of conductor elements are physically spaced and physically discrete, each from the others.

4. The smart susceptor assembly of claim 1, wherein:

the smart susceptor assembly comprises a plurality of susceptor tabs;

one of the susceptor elements is paired with one of the conductor elements to form one of the susceptor tabs;

the plurality of susceptor tabs are arranged in a plurality of rows and a plurality of columns;

the susceptor tabs within one of the rows are physically and electrically coupled to at least one other susceptor tab within the row by a pair of susceptor tab ties; and the plurality of rows are physically and electrically spaced from one or more adjacent rows by a gap.

5. The smart susceptor assembly of claim 1, wherein:

the smart susceptor assembly comprises a plurality of susceptor tabs, with each susceptor tab provided by one of the susceptor elements being paired with one of the conductor elements;

the plurality of susceptor tabs are arranged in a plurality of rows and a plurality of columns;

each row is physically spaced from one or more adjacent rows by a gap;

each susceptor tab is electrically coupled to at least one adjacent susceptor tab by a pair of susceptor tab ties; and each susceptor tab is electrically coupled to every other susceptor tab of the plurality of susceptor tabs.

6. The smart susceptor assembly of claim 1, wherein:

the smart susceptor assembly comprises a plurality of susceptor tabs, with each susceptor tab provided by one of the susceptor elements paired with one of the conductor elements; and the susceptor element of each susceptor tab is coextensive with the conductor element paired therewith.

7. The smart susceptor assembly of claim 6, wherein:

each susceptor tab has a length and a width;

the length of each susceptor tab is from 1 mm to 200 mm; and the width of each susceptor tab is from 1 mm to 100 mm.

8. The smart susceptor assembly of claim 1, wherein:

each susceptor element comprises at least one of an iron alloy, a nickel alloy, a cobalt alloy, and/or a ferrous nickel-cobalt alloy; and each conductor element comprises at least one of copper, silver, gold, bronze, and/or non-magnetic copper-nickel.

9. The smart susceptor assembly of claim 1, wherein:

the electromagnetic flux field source is at least partly provided by a conductor wire that overlies the plurality of susceptor elements; and the smart susceptor assembly further comprises an alternating current power supply electrically coupled to the conductor wire.

10. The smart susceptor assembly of claim 9, wherein:

each susceptor element of the plurality of susceptor elements is coextensive with one of the conductor elements of the plurality of conductor elements to provide a susceptor tab; and the conductor wire is physically attached to each susceptor tab.

11. A method for manufacturing a smart susceptor assembly, comprising:

forming a plurality of susceptor tabs comprising a plurality of susceptor elements and a plurality of conductor elements, wherein each susceptor element is electrically coupled to, in thermal communication with, and paired one-to-one with one of the conductor elements, and each susceptor element comprises a leveling temperature and a Curie temperature; and positioning a conductor wire of an electromagnetic flux field source adjacent to the plurality of susceptor tabs.

12. The method of claim 11, wherein the forming of the plurality of susceptor tabs comprises:

physically spacing the plurality of susceptor elements, each from the others; and physically spacing the plurality of conductor elements, each from the others.

13. The method of claim 11, further comprising:

positioning the plurality of susceptor tabs in a plurality of rows and a plurality of columns;

physically and electrically coupling the susceptor tabs of the rows to at least one other susceptor tab within the row using a pair of susceptor tab ties; and physically and electrically spacing the rows of susceptor tabs from one or more adjacent rows by a gap.

14. The method of claim 11, further comprising:

positioning the plurality of susceptor tabs in a plurality of rows and a plurality of columns;

physically spacing each row from one or more adjacent rows by a gap;

electrically coupling each susceptor tab to at least one adjacent susceptor tab using a pair of susceptor tab ties; and electrically coupling each susceptor tab to every other susceptor tab of the plurality of susceptor tabs.

15. The method of claim 11, further comprising forming each susceptor element to overlie, and to be coextensive with, one of the conductor elements.

16. The method of claim 15, further comprising forming each susceptor element of the plurality of susceptor elements and each conductor of the plurality of conductors to have a length of from 1 mm to 200 mm, and to have a width of from 1 mm to 100 mm.

17. The method of claim 11, further comprising attaching a conductor wire to each of the plurality of susceptor tabs during the positioning of the electromagnetic flux field source adjacent to the plurality of susceptor tabs, wherein the conductor wire serpentines across the plurality of susceptor tabs.

18. The method of claim 17, further comprising electrically coupling the conductor wire to an alternating current power source.

19. A method for heating an article, comprising:

placing the article adjacent to a smart susceptor assembly, wherein the smart susceptor assembly comprises:

an electromagnetic flux field source configured to generate a magnetic flux field, wherein the electromagnetic flux field source comprises a conductor wire;

a plurality of susceptor elements positioned adjacent to the conductor wire of the electromagnetic flux field source, wherein each susceptor element of the plurality of susceptor elements comprises a leveling temperature and a Curie temperature; and a plurality of conductor elements, wherein each conductor element of the plurality of conductor elements is electrically coupled to, in thermal communication with, and paired one-to-one with one of the susceptor elements of the plurality of susceptor elements;

generating an electromagnetic flux field from the conductor wire of the electromagnetic flux field source;

inductively heating the plurality of susceptor elements using the conductor wire of the electromagnetic flux field; and heating the article using heat from the plurality of susceptor elements.

20. The method of claim 19, further comprising transferring a flow of electric current from each susceptor element to one of the conductor elements prior to each susceptor element reaching the Curie temperature.

* * * * *